US010843353B2

(12) United States Patent
Phoon

(10) Patent No.: US 10,843,353 B2
(45) Date of Patent: Nov. 24, 2020

(54) ACTUATING MECHANISM FOR CONTROLLING THE CUTTING LENGTH OF A HAIR TRIMMER

(71) Applicant: KONINKLIJKE PHILIPS N.V., Eindhoven (NL)

(72) Inventor: Kin Fatt Phoon, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 94 days.

(21) Appl. No.: 15/319,863

(22) PCT Filed: May 21, 2015

(86) PCT No.: PCT/EP2015/061208
§ 371 (c)(1),
(2) Date: Dec. 19, 2016

(87) PCT Pub. No.: WO2015/197272
PCT Pub. Date: Dec. 30, 2015

(65) Prior Publication Data

US 2017/0136637 A1 May 18, 2017

(30) Foreign Application Priority Data

Jun. 27, 2014 (EP) ..... 14174818

(51) Int. Cl.
*B26B 19/20* (2006.01)
*B26B 19/06* (2006.01)
*B26B 19/38* (2006.01)

(52) U.S. Cl.
CPC ..... *B26B 19/20* (2013.01); *B26B 19/06* (2013.01); *B26B 19/3813* (2013.01)

(58) Field of Classification Search
CPC ..... B26B 19/06; B26B 19/20; B26B 19/3813; A61B 2017/32113; A61B 5/150175; F16B 5/0216; F16B 5/0225; F16B 5/0233; F16B 5/0088; F16B 5/0084; Y10T 403/591; Y10T 403/598; Y10T 403/15
(Continued)

(56) References Cited

U.S. PATENT DOCUMENTS 2,101,500 A * 12/1937 Jagus ..... G09F 1/14 40/606.13
2,648,351 A * 8/1953 Curtis ..... B60H 1/00485 251/233
(Continued)

FOREIGN PATENT DOCUMENTS

DE 3800966 7/1989
DE 3800966 A1 7/1989
RU 2394675 C1 7/2010

*Primary Examiner* — Ghassem Alie
*Assistant Examiner* — Bharat C Patel

(57) ABSTRACT

The present application relates to an actuating mechanism (2) for controlling the cutting length of a hair trimmer. An actuating mechanism employs a frame (6), an actuator (8), a sliding member (5) and a coupling mechanism (7). The actuator and sliding member are mounted to the frame and are configured to slide linearly relative to the frame. The coupling mechanism connects the actuator to the sliding member and is configured such that sliding the actuator relative to the frame causes sliding movement of the sliding member relative to the frame of a reduced distance.

20 Claims, 5 Drawing Sheets

(58) Field of Classification Search
USPC ..... 30/210, 43.4–43.92, 208, 201; 446/122, 446/123; 606/172
See application file for complete search history.

(56) References Cited

U.S. PATENT DOCUMENTS 2,718,693 A * 9/1955 Gent ..... B26B 19/20 30/31
2,851,890 A * 9/1958 Jobert ..... B23Q 5/341 74/110
3,009,633 A * 11/1961 Dilks et al. ..... G06C 7/06 235/60 R
3,085,340 A * 4/1963 Rashbaum ..... A41H 3/00 33/11
3,701,301 A * 10/1972 Gudmestad ..... B21D 43/10 83/151
4,594,777 A 6/1986 Kimoto
4,614,032 A * 9/1986 Szabo ..... B26B 21/40 30/122
4,669,189 A 6/1987 Ullmann
4,949,460 A * 8/1990 Sterk ..... B26B 19/20 30/200
5,054,199 A * 10/1991 Ogawa ..... B26B 19/06 30/200
5,084,854 A * 1/1992 Ikedo ..... G11B 17/056 720/604
5,185,931 A * 2/1993 Fujikawa ..... B26B 19/20 30/195
5,325,589 A * 7/1994 Kubo ..... B26B 19/205 30/195
5,327,648 A * 7/1994 Ullmann ..... B26B 19/20 30/200
5,699,616 A * 12/1997 Ogawa ..... B26B 19/20 30/200
5,726,828 A * 3/1998 Kakuta ..... G11B 17/028 360/98.01
5,979,060 A * 11/1999 Holzbauer ..... B26B 19/20 30/200
5,991,246 A * 11/1999 Morikawa ..... G11B 17/30 369/30.85
6,036,228 A * 3/2000 Olgren ..... B62D 1/184 280/775
6,125,545 A * 10/2000 Yamaguchi ..... B26B 19/20 30/233.5
6,276,060 B1 * 8/2001 Faulstich ..... B26B 19/20 30/34.1
6,618,948 B2 * 9/2003 Lin ..... B26B 19/20 30/233.5
6,851,910 B2 * 2/2005 Luffel ..... G11B 17/225 369/30.45
6,968,623 B2 * 11/2005 Braun ..... B26B 19/20 30/201
7,100,286 B2 * 9/2006 Nakakura ..... B26B 19/20 30/201
8,250,993 B2 * 8/2012 Griepentrog ..... G06F 1/1632 108/25
8,844,142 B2 * 9/2014 Kammer ..... B26B 19/3846 30/201
2002/0095793 A1 * 7/2002 Wilcox ..... B26B 19/20 30/201
2003/0204956 A1 * 11/2003 Chan ..... B26B 19/20 30/233.5
2012/0233865 A1 * 9/2012 Kammer ..... B26B 19/20 30/201
2013/0219724 A1 * 8/2013 Werner ..... B26B 19/20 30/201

* cited by examiner

ACTUATING MECHANISM FOR CONTROLLING THE CUTTING LENGTH OF A HAIR TRIMMER

This application is the U.S. National Phase application under 35 U.S.C. § 371 of International Application No. PCT/EP2015/061208, filed on May 21, 2015, which claims the benefit of International Application No. 14174818.6 filed on Jun. 27, 2014. These applications are hereby incorporated by reference herein.

FIELD OF THE INVENTION

The invention relates to an actuating mechanism for controlling the cutting length of a hair trimmer. The invention also relates to a cutting guide for a hair trimmer comprising said actuating mechanism and to a hair trimmer comprising the same.

BACKGROUND OF THE INVENTION

Hair trimmers are known that comprise a cutting element and a moveable cutting guide. The cutting guide is movable relative to the cutting element to adjust the cutting length of the hair trimmer.

It is known to provide a cutting guide having a rotatable mechanism to adjust the cutting length of the hair trimmer. The rotatable mechanism comprises a control knob that is rotatable to move the cutting guide relative to the cutting element of the hair trimmer. However, such rotatable mechanisms are bulky and can be difficult to manufacture.

An alternative mechanism for controlling the distance between a cutting guide and a cutting element of a hair trimmer is disclosed in U.S. Pat. No. 4,669,189. The mechanism comprises a comb that is moveable relative to the cutting element. The mechanism further comprises a control knob that is slid by a user to adjust the distance between the comb and the cutting element to control the cutting length of the hair trimmer. However, it has been found that it is difficult to accurately control the distance between the comb and the cutting element by slidably moving the control knob. In addition, it has been found that the comb tends to move towards the cutting element when the comb is urged against the user's body.

SUMMARY OF THE INVENTION

It is an object of the invention to provide an actuating mechanism, a cutting guide for a hair trimmer, and a hair trimmer which substantially alleviates or overcomes one or more of the problems mentioned above.

The invention is defined by the independent claims; the dependent claims define advantageous embodiments.

According to the present invention, there is provided an actuating mechanism for controlling the cutting length of a hair trimmer comprising a frame, an actuator mounted to the frame and configured to slide linearly relative to the frame, a sliding member mounted to the frame and configured to slide linearly relative to the frame, and a coupling mechanism connecting the actuator to the sliding member configured such that sliding the actuator relative to the frame causes sliding movement of the sliding member relative to the frame of a reduced distance.

Since sliding movement of the actuator relative to the frame causes sliding movement of the sliding member relative to the frame of a reduced distance, it is easier for the user to control the position of the sliding member and therefore the actuating mechanism can be adjusted more precisely. In addition, the coupling mechanism prevents accidental movement of the sliding member, since a greater force is required to move the sliding member by applying a force directly thereto than to move the sliding member by applying a force to slide the actuator.

In one embodiment, the actuator is configured to slide along a first direction relative to the frame and the sliding member is configured to slide linearly along the same first direction as the actuator.

In one embodiment, the coupling mechanism comprises a slot in the frame and a pin that is slidably received in the slot and wherein the coupling mechanism is configured such that sliding the actuator relative to the frame causes sliding movement of the pin within the slot which results in sliding movement of the sliding member relative to the frame. In one such embodiment, a first end of the pin is slidably received in the actuator and a second end of the pin is slidably received in the sliding member.

In one embodiment, the coupling mechanism is configured such that the pin moves in the slot in a direction perpendicular to the linear sliding direction of the actuator and/or sliding member. The coupling mechanism may further comprises a track in the actuator and a track in the sliding member, wherein a first end of the pin is located in the track in the actuator and a second end of the pin is located in the track in the sliding member.

In one embodiment, the track in the sliding member is inclined at an angle relative to the slot and the track in the actuator is inclined at an angle relative to the slot. The angle that the track in the actuator is inclined relative to the slot may be larger than the angle that the track in the sliding member is inclined relative to the slot. The track in the actuator may be inclined at an angle relative to the slot of greater than 45 degrees and/or the track in the sliding member may be inclined at an angle relative to the slot of less than 45 degrees.

In one embodiment, the track of the sliding member and/or the track of the actuator comprises a first section inclined at a first angle relative to the slot and a second section inclined at a second angle relative to the slot that is different to the first angle.

In one embodiment, the coupling mechanism is configured such that the ratio of sliding movement of the actuator to the resultant sliding movement of the sliding member is between 1:1 to 10:1 and, preferably, is between 1.5:1 to 4:1.

In one embodiment, the frame comprises opposing first and second sides and wherein the actuator is slidably disposed on the first side of the frame and the sliding member is slidably disposed on the second side of the frame. This allows for the actuating mechanism to be compact.

The frame may comprise first and second pairs of grooves, and the actuator may be slidably received in the first pair of grooves and the sliding member may be slidably received in the second pair of grooves. Therefore, the actuator and sliding member are prevented from being unintentionally separated from the frame.

In one embodiment, the cutting guide further comprises a ratchet mechanism configured to index the position of the frame relative to the sliding member and/or actuator. The ratchet mechanism allow for sliding adjustment of the sliding member relative to the frame to be indexed such that the position of the sliding member relative to the frame is easily controlled by the user. The ratchet mechanism may comprise a plurality of indexing elements on one of the frame or actuator and the other one of the frame or actuator may comprise an engaging element that selectively engages with each of the indexing elements.

According to another aspect of the invention, there is provided a cutting guide for a hair trimmer comprising the actuating mechanism according to the invention, wherein the frame is configured to be fixedly mounted to a cutting head of the hair trimmer and the sliding member comprises a sliding guide. In one such embodiment, the sliding guide comprises a sliding comb.

According to another aspect of the invention, there is provided a hair trimmer comprising a cutting head having a cutting element, and a cutting guide according to the invention.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
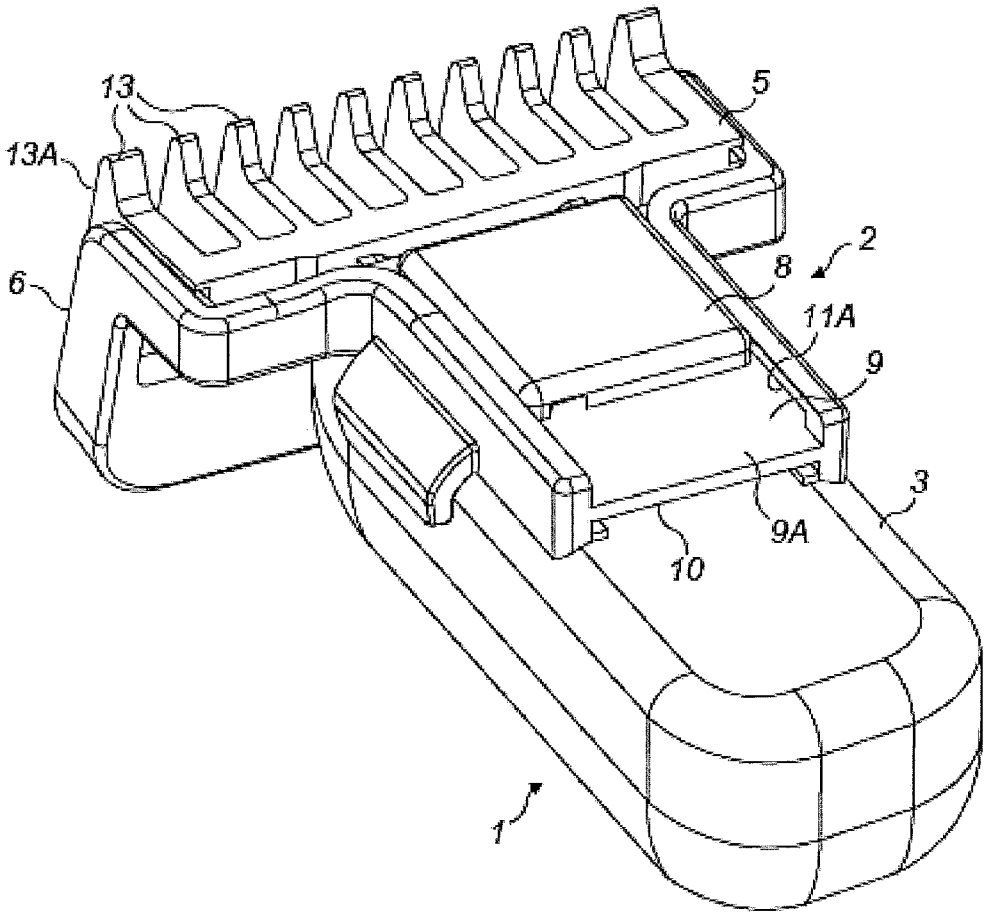
FIG. 1 is a perspective view from above of a hair trimmer comprising a cutting guide according to an embodiment of the invention.
Figure 2:
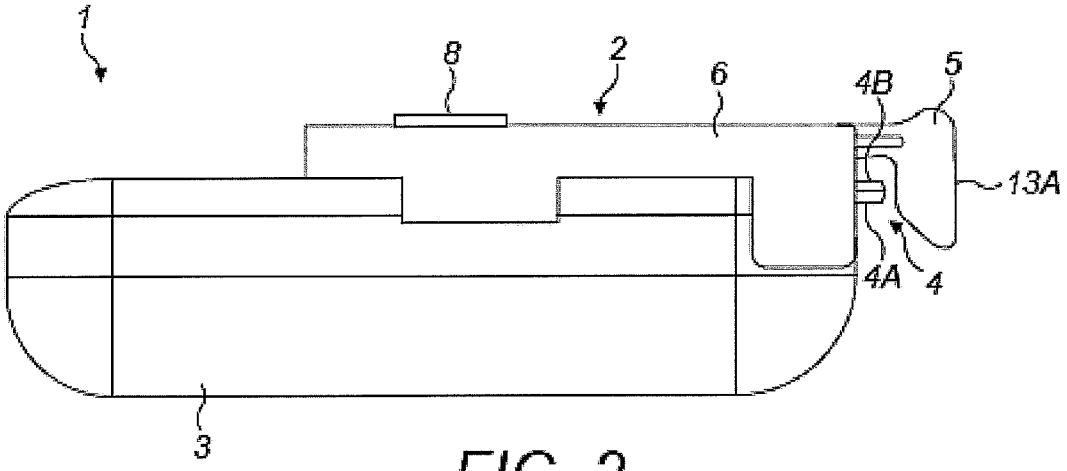
FIG. 2 is a side view of the hair trimmer of FIG. 1.
Figure 3:
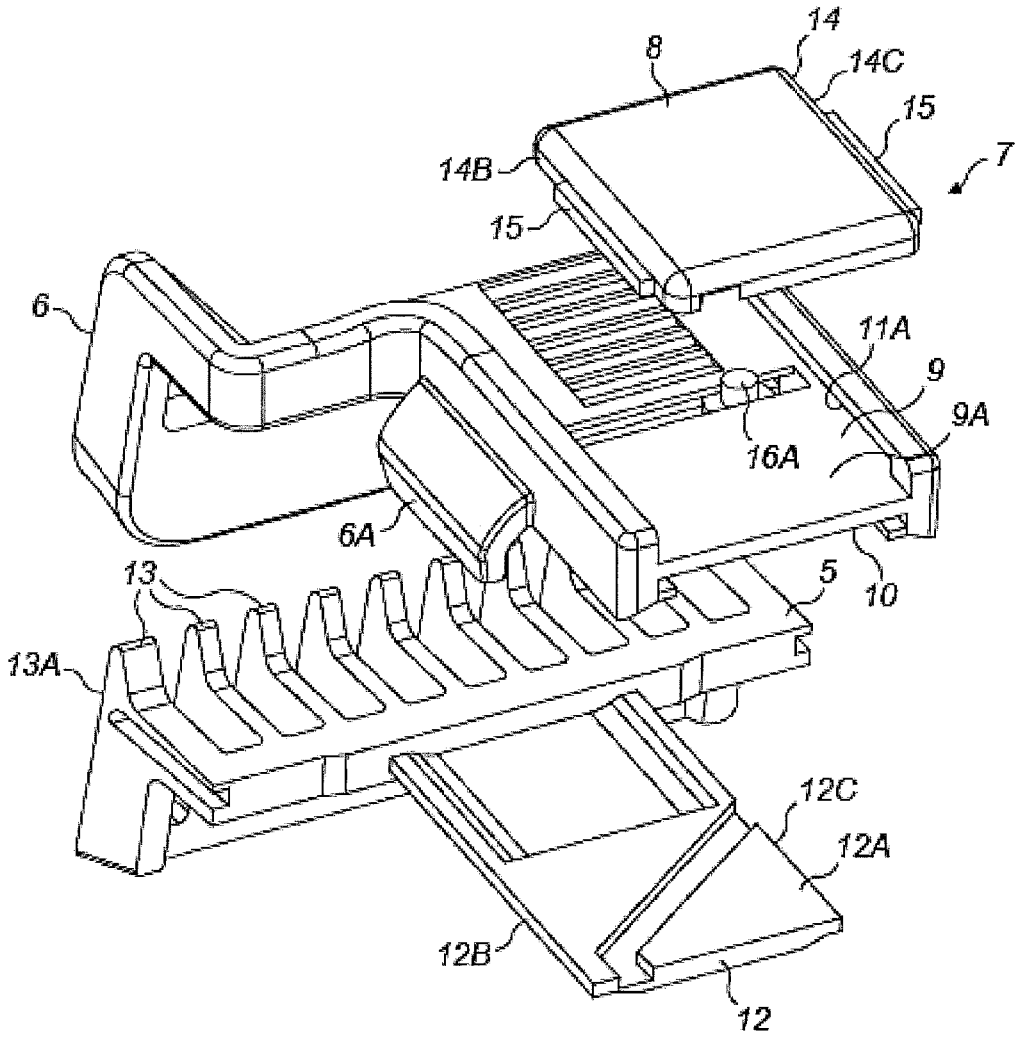
FIG. 3 is an exploded perspective view from above of the cutting guide of FIG. 1.
Figure 4:
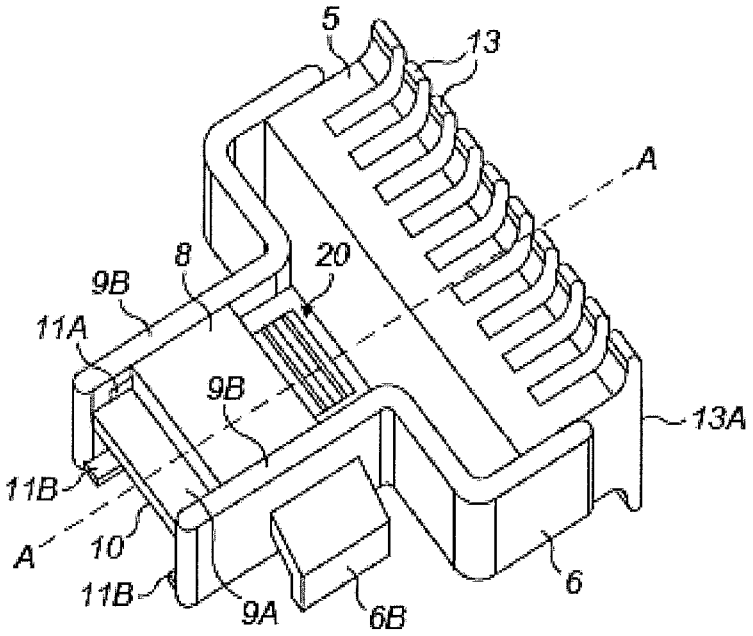
FIG. 4 is an assembled perspective view from above of the cutting guide of FIG. 1.
Figure 5:
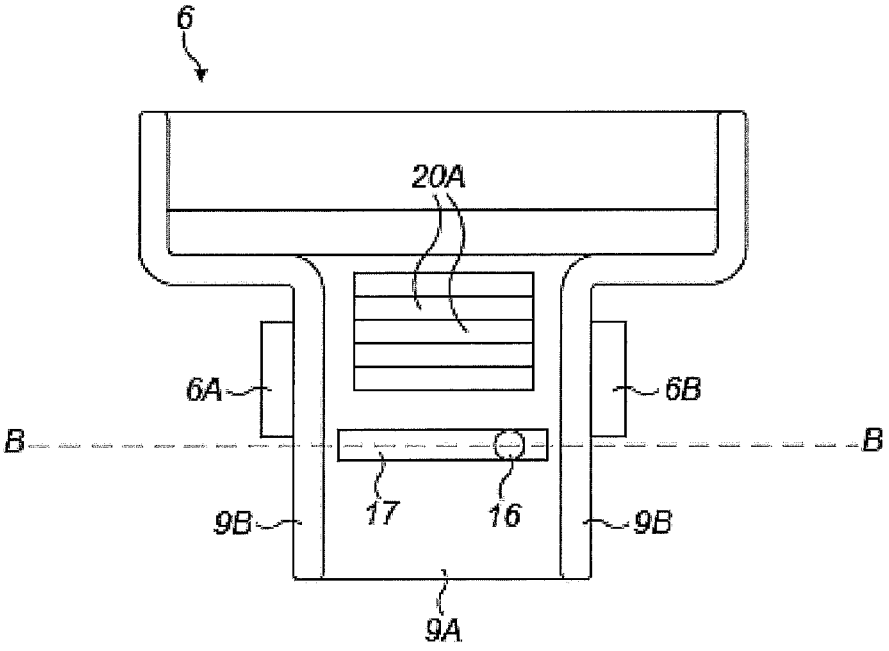
FIG. 5 is a top view of a frame and pin of the cutting guide of FIG. 1.
Figure 6:
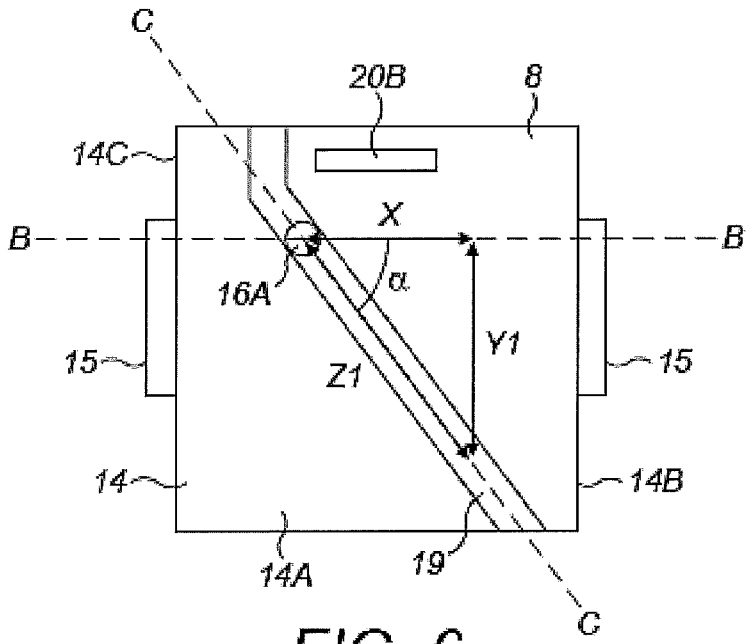
FIG. 6 is a bottom view of an actuator and a pin of the cutting guide of FIG. 1.
Figure 7:
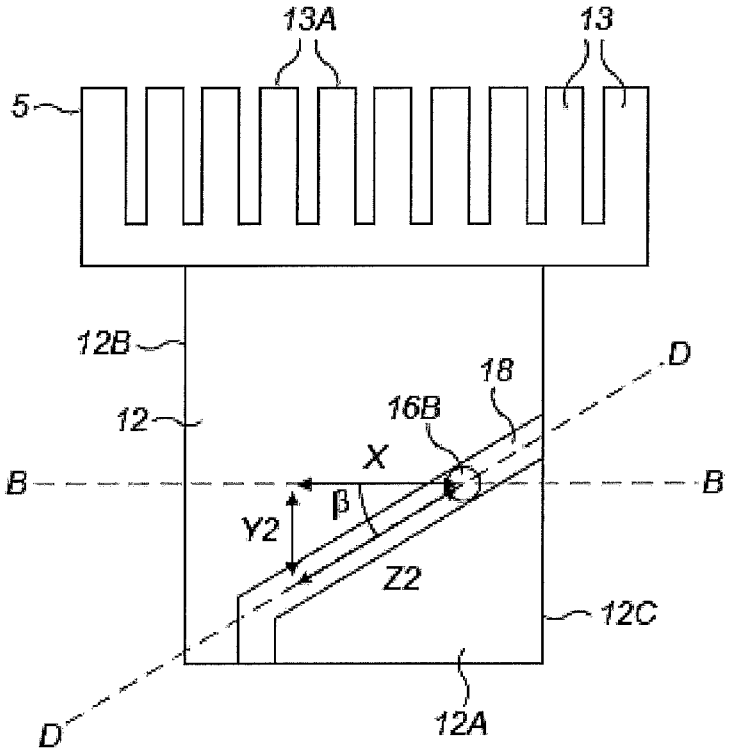
FIG. 7 is a top view of a comb and the pin of the cutting guide of FIG. 1; and, FIG. 8 is a graph showing the relationship between the comb track angle and the reaction holding force for cutting guides having actuator track angles of 20, 55, 65 and 75.

Referring now to FIGS. 1 to 8, a hair trimmer 1 comprising an actuating mechanism in the form of a cutting guide 2 according to an embodiment of the invention is shown. The hair trimmer 1 is a hand-held electrical hair trimming device. However, it will be apparent that the hair trimmer 1 may have an alternative arrangement. For example, the hair trimmer 1 may be a hand-held electrical shaving device (not shown). The hair trimmer 1 is moved over a user's body to trim hair on that part of the body.

The hair trimmer 1 comprises a main body 3 and a cutting element 4 at one end of the main body 3. The cutting element 4 is configured to cut hair. The cutting element 4 comprises a stationary cutting blade 4A and a moveable cutting blade 4B. The moveable cutting blade 4B is moveable relative to the stationary cutting blade 4A by, for example, an electric motor (not shown).

The stationary cutting blade 4A has a stationary edge (not shown) comprising a first array of teeth. The moveable cutting blade 4B has a moveable edge (not shown) comprising a second array of teeth. The stationary edge and moveable edge are aligned parallel to each other. The moveable cutting blade 4B is moveable in a reciprocal manner against the stationary cutting blade 4A in a hair shearing engagement. Therefore, the second array of teeth is arranged to move in a reciprocal motion relative to the first array of teeth such that the first and second arrays of teeth form cooperating mechanical cutting parts (not shown). Hairs that protrude past the stationary cutting blade 4A are cut by the moveable cutting blade 4B.

The cutting guide 2 comprises a sliding member in the form of a sliding guide 5, frame 6, coupling mechanism 7 and actuator 8. The frame 6 comprises first and second frame arms 6A, 6B that clip onto the main body 3 such that the frame 6 is removably mounted to the main body 3.

The frame 6 comprises first and second sides 9, 10 that face in opposite directions. The first side 9 of the frame 6 comprises a major surface 9A and an opposing pair of raised edges 9B at the periphery of the major surface 9A. The second side 10 of the frame 6 comprises a major surface 10A and an opposing pair of raised edges 10B at the periphery of the major surface 10A. The pair of raised edges 9B of the first side 9 comprise a corresponding first pair of grooves 11A and the pair of raised edges 10B of the second side 10 comprise a corresponding second pair of grooves 11B. The first and second pairs of grooves 11A, 11B extend linearly in the same direction.

The sliding guide 5 is in the form of a comb 5. The comb 5 comprises a comb planar member 12 and a plurality of comb teeth 13 proximate one end of the comb planar member 12. The comb planar member 12 comprises a major surface 12A that is located against the major surface 10A of the second side 10 of the frame 6. The comb planar member 12 comprises distal first and second edges 12B, 12C that are slidably received in the second pair of grooves 11B of the frame 6 such that the comb 5 is mounted to the frame 6 and is slidable relative to the frame 6 in a first linear direction A-A (see FIG. 4). The comb teeth 13 cover the cutting element 4 of the hair trimmer 1.

The plurality of comb teeth 13 are spaced and parallel to each other. The spacing of the comb teeth 13 allows for the passage of hair between the comb teeth 13 such that said hair is exposed to the cutting element 4 to be cut by the cutting element 4. A distal surface of each of the comb teeth 13 from the main body 3 of the hair trimmer 1 forms a guide face 13A that is configured to be disposed against the part of the body to be treated. The guide face 13A is spaced from the cutting element 4. The guide face 13A is arranged to space the cutting element 4 from the part of the body to be trimmed, for example the skin of a user's head.

The actuator 8 comprises an actuator planar member 14 having a major surface 14A that is located against the major surface 9A of the first side 9 of the frame 6. The actuator planar member 14 comprises distal first and second edges 14B, 14C. The first and second edges 14B, 14C of the actuator planar member 14 approximately respectively overlie the first and second edges 12B, 12C of the comb planar member 12. A pair of protrusions 15 extend from the first and second edges 14B, 14C of the actuator planar member 14. The protrusions 15 are slidably received in the second pair of grooves 11B of the frame 6 such that the actuator 8 is mounted to the frame 6 and is slidable relative to the frame 6 in the first linear direction A-A.

The coupling mechanism 7 is configured such that sliding linear movement of the actuator 8 relative to the frame 6 along the first linear direction A-A is translated into sliding linear movement of the comb 5 relative to the frame 6 along the first linear direction A-A. This allows for the user to adjust the spacing between the guide face 13A and the cutting element 4, and therefore to adjust the cutting length of the hair trimmer 1, by sliding the actuator 8 relative to the frame 6.

The coupling mechanism 7 comprises a pin 16, a slot 17 in the frame 6, a comb track 18 and an actuator track 19. The slot 17 extends through the thickness of the frame 6 from the first side 9 to the second side 10 and extends longitudinally in a direction perpendicular to first linear direction A-A. The pin 16 is slidably received in the slot 17 and is slidable relative to the frame 6 in a second linear direction B-B (see FIG. 5) that corresponds to the longitudinal direction of the slot 17, perpendicular to the first linear direction A-A. The pin 16 comprises a first end 16A and a distal second end 16B. The first end 16A of the pin 16 protrudes from the major surface 9A of the first side 9 of the frame 6 and the second end 16B of the pin 16 protrudes from the major surface of the second side 10 of the frame 6.

The cutting guide 2 comprises a ratchet mechanism 20 comprising a plurality of depressions 20A in the major surface 9A on the first side 9 of the frame 6 and a projection 20B on the major surface 14A of the actuator planar member 14. The ratchet mechanism 20 is configured such that the projection 20B sequentially snaps into or engages with one of the plurality of depressions 20A as the actuator 8 is slid relative to the frame 6 to index the sliding movement therebetween. In the present embodiment, the plurality of depressions 20A are spaced such that the movement of the actuator 8 relative to the frame 6 is indexed into 1 mm increments. However, the ratchet mechanism 20 may alternatively be configured such that the movement of the actuator 8 relative to the frame 6 is indexed into increments of a different size.

The actuator track 19 is formed in the major surface 14A of the actuator 8 that locates against the major surface 9A of the first side 9 of the frame 6. The actuator track 19 extends in a third linear direction C-C (see FIG. 6) that is at an angle to the slidable direction of the actuator 8 relative to the frame 6 and at an angle to the longitudinal direction of the slot 17. Therefore, the third linear direction C-C along which the actuator track 19 longitudinally extends is at an angle to the first linear direction A-A and at an angle to the second linear direction B-B. The angle of the actuator track 19 with respect to the second linear direction B-B is referred to hereinafter as the 'actuator track angle α'. The actuator track 19 is orientated such that the distance between the actuator track 19 and the first edge 14B of the actuator planar member 14 increases in the first linear direction A-A towards the comb teeth 13.

The comb track 18 is formed in the major surface 12A of the comb 5 that locates against the major surface 10A of the second side 10 of the frame 6. The comb track 18 extends in a fourth linear direction D-D (see FIG. 7) that is at an angle to the slidable direction of the comb 5 relative to the frame 6 and at an angle to the longitudinal direction of the slot 17. Therefore, the fourth linear direction D-D along which the comb track 18 longitudinally extends is at an angle to the first linear direction A-A and at an angle to the second linear direction B-B. The angle of the comb track 18 with respect to the second linear direction B-B is referred to hereinafter as the 'comb track angle β'. The comb track 18 is orientated such that the distance between the comb track 18 and the first edge 12B of the comb planar member 12 increases in the first linear direction A-A towards the comb teeth 13.

The first end 16A of the pin 16 is slidably received in the actuator track 19 such that the pin 16 is slidable relative to the actuator 8 in the third linear direction C-C. The second end 16B of the pin 16 is slidably received in the comb track 18 such that the pin 16 is slidable relative to the comb 5 in the fourth linear direction D-D.

The coupling mechanism 7 is configured such that when the actuator 8 is slid relative to the frame 6 in the first linear direction A-A by a distance Y1 towards the comb teeth 13, an edge of the actuator track 19 is urged against the first end 16A of the pin 16 such that the pin 16 moves along the actuator track 19 in the third liner direction C-C by a distance Z1. This causes the pin 16 to move in the slot 17 in the second linear direction B-B by a distance X (see FIG. 6).

The distance that the pin 16 moves in the slot 17 due to sliding movement of the actuator 8 relative to the frame 6 is dependent on the actuator track angle α. The relationship between actuator track angle α, the distance Y1 of the sliding movement of the actuator 8 relative to the frame 6 and the distance X of the resulting movement of the pin 16 in the slot 17 is shown in Equation 1.

$$Y1 = X\tan(\alpha) \quad \text{[Equation 1]}$$

When the pin 16 moves relative to the frame 6 by distance X, the second end 16B of the pin 16 moves along the comb track 18 in the fourth linear direction D-D by a distance Z2 and the pin 16 is urged against an edge of the comb track 18 such that the comb 5 is slid relative to the frame 6 in the first linear direction A-A by a distance Y2 (see FIG. 7) such that the comb teeth 13 move away from the cutting element 4. Therefore, sliding movement of the actuator 8 relative to the frame 6 in the first linear direction A-A by distance Y1 towards the comb teeth 13 causes sliding movement of the comb 5 relative to the frame 6 in the first linear direction A-A by distance Y2 such that the comb teeth 13 move away from the cutting element 4 to increase the cutting length. Conversely, sliding movement of the actuator 8 relative to the frame 6 in the first linear direction A-A away from the comb teeth 13 causes sliding movement of the comb 5 relative to the frame 6 in the first linear direction A-A such that the comb teeth 13 move towards the cutting element 4 to decrease the cutting length.

The distance that the comb 5 moves relative to the frame 6 due to movement of the pin 16 in the slot 17 is dependent on the comb track angle β. The relationship between the comb track angle β, the distance X of the movement of the pin 16 in the slot 17 and the distance Y2 of the resultant sliding movement of the comb 5 relative to the frame 6 is shown in Equation 2.

$$Y2 = X\tan(\beta) \quad \text{[Equation 2]}$$

The relationship between the actuator track angle α, the comb track angle β, the distance Y1 of the sliding movement of the actuator 8 relative to the frame 6 and the distance Y2 of the resulting movement of the comb 5 relative to the frame 6 is shown in Equation 3.

$$\frac{Y2}{Y1} = \frac{\tan(\beta)}{\tan(\alpha)} \quad \text{[Equation 3]}$$

The actuator track angle α is greater than 45 degrees and less than 90 degrees and therefore sliding movement of the actuator 8 relative to the frame 6 by distance Y1 will result in movement of the pin 16 in the slot 17 by a smaller distance X. The greater the actuator track angle α within the range of between 45 degrees and 90 degrees, the smaller the distance that the pin 16 moves in the slot 17 due to sliding movement of the actuator 8 relative to the frame 6 and therefore the smaller the distance of the resulting sliding movement of the comb 5. In the present embodiment, the actuator track angle α is 55 degrees and therefore movement of the actuator 8 relative to the frame 6 by 1 mm will result in movement of the pin 16 in the slot 17 by 0.7 mm. However, it will be recognised that other actuator track angles α are intended to fall within the scope of the invention.

The comb track angle β is greater than 0 degrees and less than 45 degrees and therefore movement of the pin 16 in the slot 17 by distance X will result in movement of the comb 5 relative to the frame 6 by a smaller distance Y2. The smaller the comb track angle β within the range of between 0 degrees and 45 degrees, the smaller the distance that the comb 5 moves relative to the frame 6 due to movement of the pin 16 in the slot 17. In the present embodiment, the comb track angle β is 35 degrees and therefore movement of the pin 16 in the slot 17 by 0.7 mm will result in movement of the comb 5 relative to the frame 6 by 0.5 mm. Therefore, a 1 mm sliding movement of the actuator 8 relative to the frame 6 results in a 0.5 mm movement of the comb 5 relative to the frame 6 such that the cutting length of the hair trimmer 1 is adjusted by 0.5 mm. Therefore, the coupling mechanism 7 provides a 2:1 ratio of movement of the actuator 8 relative to the comb 5. However, it will be recognised that other comb track angles β are intended to fall within the scope of the invention.

Since sliding movement of the actuator 8 relative to the frame 6 causes sliding movement of the comb 5 relative to the frame 6 of a reduced distance, it is easier for the user to control the cutting length of the hair trimmer 1. More specifically, the resolution of adjustment of the comb teeth 13 relative to the cutting element 4 is increased such that the cutting length can be adjusted more precisely.

When the comb 5 is urged against the user's body during use, a force is exerted directly on the comb 5 that can result in the comb 5 being urged to move relative to the frame 6, which can result in accidental adjustment of the cutting length of the hair trimmer 1. To prevent such accidental movement of the comb 5, the coupling mechanism 7 is configured to exert a reaction holding force on the actuator 8 to prevent movement of the actuator 8, and therefore to prevent movement of the comb 5, in the event that a force is exerted directly on the comb 5. In the present embodiment, this reaction holding force is provided by the ratchet mechanism 20 and is the force that must be exerted on the actuator 8 to urge the projection 20B of the ratchet mechanism 20 out of a depression 20A and into an adjacent depression 20A such that the actuator 8 slides relative to the frame 6.

The magnitude of the reaction holding force that is required to prevent unintentional movement of the comb 5 is dependent on the comb track angle β, the friction coefficient of the coupling mechanism 7, and the size of the force that is exerted directly on the comb 5 by, for example, the comb 5 being urged against the user's body. The friction coefficient of the coupling mechanism 7 is the total friction coefficient between all moving components of the coupling mechanism 7. More specifically, the friction coefficient is a result of the friction between the first end 16A of the pin 16 and the actuator track 19, the second end 16B of the pin 16 and the comb track 18, the pin 16 and the slot 17 in the frame 6, the actuator 8 and the frame 6, and the comb 5 and the frame 6.

It has been found that the larger the reaction holding force of the ratchet mechanism 20, the larger the force that must be exerted directly on the comb 5 to move the comb 5 relative to the frame 6. However, if the ratchet mechanism 20 has a large reaction holding force then a large force must be exerted on the actuator 8 by the user when it is desired to slide the actuator 8 relative to the frame 6 to adjust the cutting length of the hair trimmer 1. Therefore, a large reaction holding force can make the cutting guide 2 more difficult to operate, particularly if the user is elderly or infirm.

The coupling mechanism 7 reduces the magnitude of the reaction holding force that is required to prevent accidental movement of the comb 5. More specifically, since the comb track 18 is angled with respect to the sliding direction of the comb 5, when a force is exerted directly on the comb 5 an edge of the comb track 18 will be urged against the second end 16B of the pin 16 such that movement of the comb 5 relative to the frame 6 is resisted. It has been found that the smaller the comb track angle β, the greater the force that must be exerted directly on the comb 5 to move the comb 5 relative to the frame 6 and therefore the smaller the reaction holding force that is required to prevent accidental movement of the comb 5.

Figure 8:
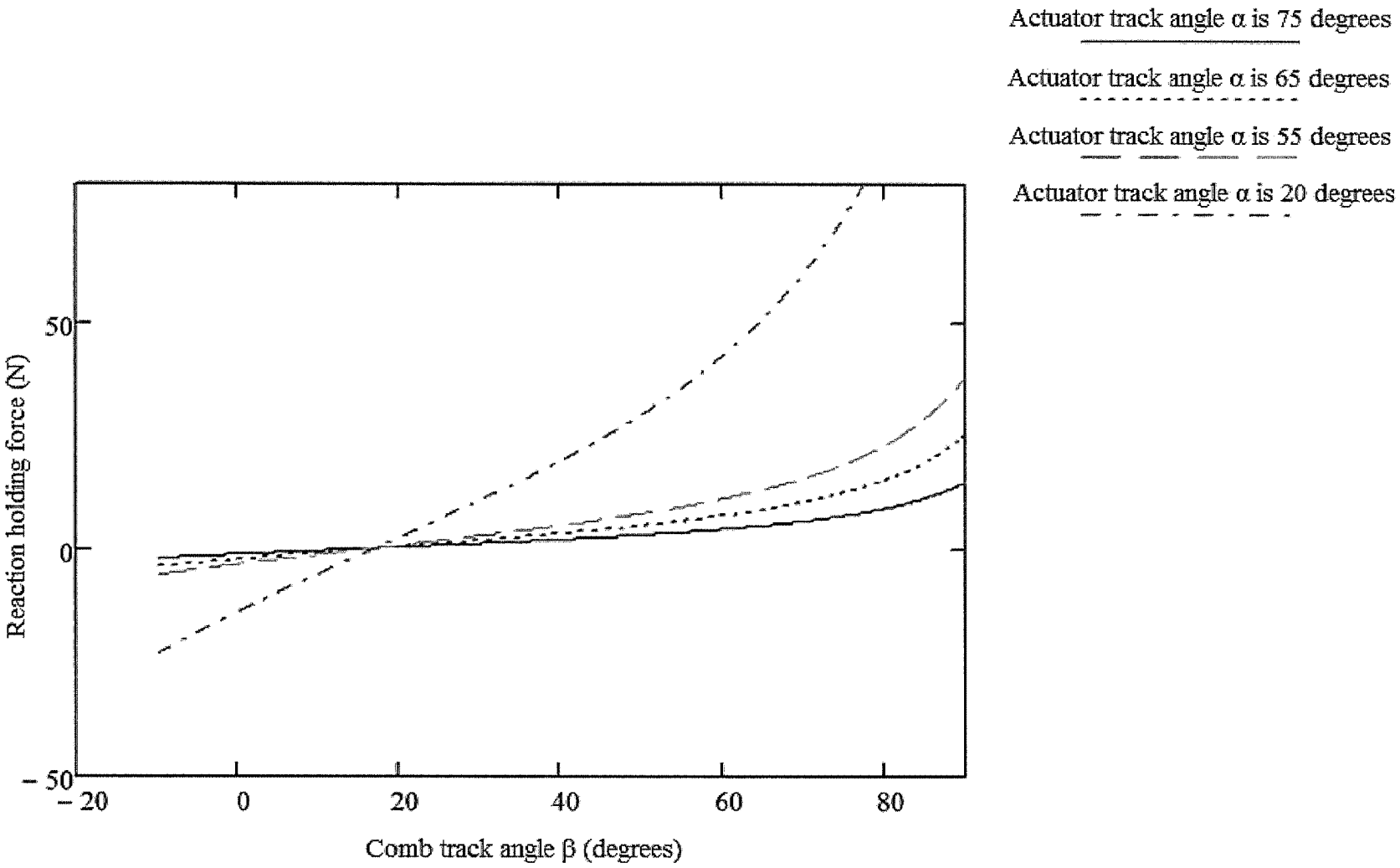

The relationship between the comb track angle β and the reaction holding force required to prevent accidental movement of the comb 5 when a force of 15 N is exerted directly on the comb 5 is illustrated graphically in FIG. 8. The graph of FIG. 8 shows this relationship for cutting guides having coupling mechanisms with actuator track angles α of 20, 55, 65 and 75 degrees, wherein each coupling mechanism has a friction coefficient of 0.15 degrees. When the friction coefficient is 0.15 and the comb track angle β is equal to or less than 18 degrees, no reaction holding force is necessary to prevent movement of the comb 5 when a force of 15 N is exerted directly on the comb 5. It should be recognised that if the friction coefficient of the coupling mechanism 7 is increased, the maximum comb track angle β that ensures that no reaction holding force is necessary to prevent accidental movement of the comb 5 is also increased.

Although in the above described embodiment the ratchet mechanism 20 comprises a plurality of depressions 20A in the frame 6 and a projection 20B on the actuator 8, in an alternative embodiment (not shown) a plurality of projections are provided on the frame and a depression or projection is provided on the actuator to sequentially engage one of the plurality of projections as the actuator is slid relative to the frame. In another embodiment (not shown), the plurality of depressions are provided on one of the frame or comb and the projection is provided on the other one of the frame or comb to index the movement of the comb relative to the frame. In yet another embodiment (not shown), the ratchet mechanism is omitted.

In the above described embodiment the coupling mechanism 7 is configured such that sliding movement of the actuator 8 relative to the frame 6 towards from the comb teeth 13 causes sliding movement of the comb 5 relative to the frame 6 such that the comb teeth 13 move away from the cutting element 4 to increase the cutting length. However, in an alternative embodiment (not shown) the coupling mechanism is configured such that sliding movement of the actuator relative to the frame towards the comb teeth causes sliding movement of the comb relative to the frame such that the comb teeth move towards the cutting element to decrease the cutting length. For example, in one embodiment the actuator track is instead orientated such that the distance between the actuator track and the first edge of the actuator planar member decreases in the first linear direction towards the comb teeth.

Although in the above described embodiment the cutting element 4 comprises a stationary cutting blade 4A and a moveable cutting blade 4B, it will be understood that alternative cutting element arrangements are envisaged. For example, the cutting element 4 may comprise a foil (not shown) through which hairs protrude, and a moving blade (not shown) which moves over the foil to cut the hair.

Although in the above described embodiment the sliding guide 5 is in the form of a comb 5, in alternative embodiments (not shown) the sliding guide is of a different arrangement. For example, the sliding guide may alternatively comprise a mesh or a grill that is slid relative to the cutting element upon sliding movement of the actuator by the user.

In the above described embodiment the cutting guide 2 is removably mounted to the main body 3 of the hair trimmer 1. This allows for the cutting guide 2 to be removed by the user and cleaned and the cutting guide 2 to be interchangeable with another cutting guide and/or replaced. However, in alternative embodiments (not shown) the cutting guide 2 is permanently secured to the main body 3 of the hair trimmer 1 or is integrally formed with the main body 3 of the hair trimmer 1.

Although in the above described embodiments the actuator track angle $\alpha$ is greater than 45 degrees and the comb track angle $\beta$ is less than 45 degrees, in alternative embodiments (not shown) the actuator track angle $\alpha$ is equal to or less than 45 degrees or the comb track angle $\beta$ is equal to or greater than 45 degrees. In such an embodiment, the actuator track angle $\alpha$ should be greater than the comb track angle $\beta$ to ensure that sliding movement of the actuator 8 relative to the frame 6 results in sliding movement of the comb 5 relative to the frame 6 of a reduced distance.

Although in the above described embodiment the coupling mechanism 7 comprises an actuator track 19 that receives the first end 16A of the pin 16, in an alternative embodiment (not shown) the actuator track is omitted and instead the actuator is rigidly connected directly to the first end of the pin. In such an alternative embodiment, the actuator is slidable relative to the frame along the second linear direction to urge the pin to move in the slot in the second linear direction.

Although in the above described embodiment the actuating mechanism is in the form of a cutting guide 2 comprising a sliding guide 5 that is slidably adjustable to control the cutting length of the hair trimmer 1, in alternative embodiments (not shown) the actuating mechanism is of an alternative configuration. In one such embodiment (not shown), the actuating mechanism comprises a sliding member that is fixedly attached to the moveable blade of a cutting element. The cutting element further comprises a stationary blade. The coupling mechanism is configured such that sliding the actuator relative to the frame results in sliding movement of the sliding member such that the moveable blade is slid relative to the stationary blade to adjust the cutting length of the hair trimmer.

In the above described embodiment, the actuator track angle $\alpha$ is constant along the length of the actuator track 19 and the comb track angle $\beta$ is constant along the length of the comb track 18. However, in alternate embodiments (not shown) the actuator track angle $\alpha$ varies along the length of the actuator track 19 and/or the comb track angle $\beta$ varies along the length of the comb track 18 such that the ratio of movement of the actuator 8 relative to corresponding movement of the comb 5 varies depending on the position of the actuator 8 with respect to the frame 6. In one such embodiment (not shown), the actuator track comprises a first section at a first angle to the slot in the frame and a second section at a second angle to the slot in the frame. Therefore, when the actuator is moved relative to the frame, the ratio of movement of the actuator relative to corresponding movement of the comb will depend on whether the first end of the pin is in the first section or second section of the actuator track.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. An actuating mechanism for a hair trimmer including a cutting head having a cutting element, the actuating mechanism comprising:

a frame mountable to the cutting head;

an actuator mounted to the frame and configured to slide linearly relative to the frame;

a sliding member mounted to the frame and configured to slide linearly relative to the frame; and a coupling mechanism connecting the actuator to the sliding member, wherein the coupling mechanism includes a slot in the frame and a pin that is slidably received in the slot, wherein the coupling mechanism further includes an actuator track in the actuator and a sliding track in the sliding member, wherein a first end of the pin is located in the actuator track in the actuator and a second end of the pin is located in the sliding track in the sliding member, and wherein a sliding movement of the actuator relative to the frame causes a sliding movement of the pin within the slot, a sliding movement of the first end of the pin within the actuator track, and a sliding movement of the second end of the pin within the sliding track, which results in a sliding movement of the sliding member relative to the frame.

2. The actuating mechanism according to claim 1, wherein the actuator is configured to slide along a first direction relative to the frame and the sliding member is configured to slide linearly along the same first direction as the actuator.

3. The actuating mechanism according to claim 1, wherein the coupling mechanism is configured such that the pin moves in the slot in a direction that is perpendicular to at least one of a linear sliding direction of the actuator relative to the frame and a linear sliding direction of the sliding member relative to the frame.

4. The actuating mechanism according to claim 1, wherein the sliding track in the sliding member is inclined at an angle relative to the slot and the actuator track in the actuator is inclined at an angle relative to the slot.

5. The actuating mechanism according to claim 4, wherein the angle that the actuator track in the actuator is inclined relative to the slot is larger than the angle that the sliding track in the sliding member is inclined relative to the slot.

6. The actuating mechanism according to claim 4, wherein at least one of:

the actuator track in the actuator is inclined at the angle relative to the slot of greater than 45 degrees, and the sliding track in the sliding member is inclined at the angle relative to the slot of less than 45 degrees.

7. The actuating mechanism according to claim 1, wherein a ratio of the sliding movement of the actuator relative to the frame to the resultant sliding movement of the sliding member relative to the frame is between 1:1 to 10:1.

8. The actuating mechanism according to claim 1, wherein the frame includes opposing first and second sides, and wherein the actuator is slidably disposed on the first side of the frame and the sliding member is slidably disposed on the second side of the frame.

9. The actuating mechanism according to claim 1, wherein the frame includes a first pair of grooves and a second pair of grooves, and wherein the actuator is slidably received in the first pair of grooves and the sliding member is slidably received in the second pair of grooves.

10. The actuating mechanism according to claim 1, further comprising:

a ratchet mechanism configured to index the position of the frame relative to at least one of the sliding member and the actuator.

11. The actuating mechanism according to claim 10, wherein the ratchet mechanism includes a plurality of indexing elements on one of the frame or the actuator, and wherein the other one of the frame or the actuator includes an engaging element that selectively engages with each of the indexing elements.

12. A hair trimmer, comprising:

a cutting head having a cutting element; and an actuating mechanism including:

a frame mounted to the cutting head;

an actuator mounted to the frame and configured to slide linearly relative to the frame;

a sliding member mounted to the frame and configured to slide linearly relative to the frame; and a coupling mechanism connecting the actuator to the sliding member, wherein the coupling mechanism includes a slot in the frame and a pin that is slidably received in the slot, wherein the coupling mechanism further includes an actuator track in the actuator and a sliding track in the sliding member, wherein a first end of the pin is located in the actuator track in the actuator and a second end of the pin is located in the sliding track in the sliding member, and wherein a sliding movement of the actuator relative to the frame causes a sliding movement of the pin within the slot, a sliding movement of the first end of the pin within the actuator track, and a sliding movement of the second end of the pin within the sliding track, which results in a sliding movement of the sliding member relative to the frame.

13. The hair trimmer according to claim 12, wherein the actuator is configured to slide along a first direction relative to the frame and the sliding member is configured to slide linearly along the same first direction as the actuator.

14. The hair trimmer according to claim 12, wherein the coupling mechanism is configured such that the pin moves in the slot in a direction that is perpendicular to at least one of a linear sliding direction of the actuator relative to the frame and a linear sliding direction of the sliding member relative to the frame.

15. The hair trimmer according to claim 12, wherein the sliding track in the sliding member is inclined at an angle relative to the slot and the actuator track in the actuator is inclined at an angle relative to the slot.

16. The hair trimmer according to claim 15, wherein the angle that the actuator track in the actuator is inclined relative to the slot is larger than the angle that the sliding track in the sliding member is inclined relative to the slot.

17. The hair trimmer according to claim 15, wherein at least one of:

the actuator track in the actuator is inclined at an angle relative to the slot of greater than 45 degrees, and the sliding track in the sliding member is inclined at an angle relative to the slot of less than 45 degrees.

18. The hair trimmer according to claim 12, wherein the frame includes opposing first and second sides, and wherein the actuator is slidably disposed on the first side of the frame and the sliding member is slidably disposed on the second side of the frame.

19. The hair trimmer according to claim 12, wherein the frame includes a first pair of grooves and a second pair of grooves, and wherein the actuator is slidably received in the first pair of grooves and the sliding member is slidably received in the second pair of grooves.

20. The hair trimmer according to claim 12, further comprising:

a ratchet mechanism configured to index the position of the frame relative to at least one of the sliding member and the actuator.

* * * * *